US005330102A

United States Patent [19]

Jarvis et al.

[11] Patent Number: 5,330,102

[45] Date of Patent: Jul. 19, 1994

[54] SPRAY ARM INLET FOR DISHWASHER

[75] Inventors: Wilbur W. Jarvis, St. Joseph Township, Berrien County; Roger J. Bertsch, Lincoln Township, Berrien County, both of Mich.

[73] Assignee: Whirlpool Corporation, Benton Harbor, Mich.

[21] Appl. No.: 19,842

[22] Filed: Feb. 19, 1993

[51] Int. Cl.[5] ..... B05B 3/06

[52] U.S. Cl. ..... 239/228; 239/251; 239/553; 134/179

[58] Field of Search ..... 239/231, 228, 243, 244, 239/245, 251, 553; 134/179

[56] References Cited

U.S. PATENT DOCUMENTS

| | | | |
|---|---|---|---|
| 1,518,412 | 12/1924 | Ross | 239/553 |
| 2,362,433 | 11/1944 | Ferguson et al. | 239/553 |
| 3,180,348 | 4/1965 | Clearman | 239/251 |
| 3,444,870 | 5/1969 | Lyman | 134/179 |
| 3,648,931 | 3/1972 | Jacobs | 134/179 |
| 3,878,992 | 4/1975 | MacManus | 239/553 |
| 3,918,644 | 11/1975 | Platt et al. | 239/251 |
| 3,951,684 | 4/1976 | LaPrad et al. | 239/251 |
| 4,266,565 | 5/1981 | Gurubatham | 134/144 |
| 4,301,822 | 11/1981 | Dingler | 134/176 |
| 4,418,868 | 12/1983 | Gurubatham et al. | 239/251 |

FOREIGN PATENT DOCUMENTS

| | | | |
|---|---|---|---|
| 1628711 | 8/1971 | Fed. Rep. of Germany | 134/179 |

*Primary Examiner*—Karen B. Merritt

*Attorney, Agent, or Firm*—Hill, Steadman & Simpson

[57] ABSTRACT

An inlet construction is provided which is particularly useful in a spray arm for a dishwasher. The inlet is formed of a circular opening in a bottom wall of the spray arm and a flat plate positioned within the hollow arm, above the opening and generally perpendicular to the direction of the liquid jet directed at the underside of the arm. The plate is held in place by being pressed against a plurality of spacers formed on the bottom wall of the arm by resilient fingers positioned adjacent to each of the spacers. The liquid jet strikes the plate and the liquid is forced radially outwardly into the arms of the spray arm to be ejected from openings in the spray arm.

18 Claims, 2 Drawing Sheets

SPRAY ARM INLET FOR DISHWASHER

BACKGROUND OF THE INVENTION

The present invention relates to dishwashers and more particularly to an inlet for a spray arm used with an automatic dishwasher.

Automatic dishwashers generally comprise an enclosure for receiving dishes, utensils and other items to be washed. Usually there are one or more racks of a wire frame type which support the various articles to be washed. Wash liquid is directed against the articles in the form of a pressurized spray through spray orifices generally carried on rotating arms which assure wide coverage by the spray.

Where multiple levels of racks are utilized, it is known to use a separate spray arm for each rack in order to provide complete coverage by the wash liquid. However, since in domestic dishwashers the individual dish racks move independently, a physical connection from the source of pressurized wash liquid to the upper spray arms is not feasible. In the past, the upper spray arm has been provided with a horizontally loose funnel shaped member opening downwardly and the lower spray rack has been provided with a tower having an open upper end such that wash liquid under pressure is ejected from the tower upwardly into the funnel inlet in the upper arm causing the upper arm to fill with wash liquid with the wash liquid then exiting through various spray orifices in the upper arm.

While such an arrangement has achieved a certain degree of effectiveness, there is a certain amount of splash back when using such a structure, particularly when the top rack is not positioned precisely with respect to the lower spray post.

SUMMARY OF THE INVENTION

The present invention provides an improved inlet for a dishwasher spray arm in which the back splashing of wash liquid directed at the spray arm is minimized and the number and complexity of the parts required for the spray inlet are reduced.

A standard upper spray arm has a large, circular opening on a lower side in the central hub area. Secured within the hollow interior of the spray arm, and just above a floor of the lower portion of the arm is a flat plate which is held directly above the opening. The plate has a diameter greater than the opening. As the water jet from the lower tower flows upwardly and strikes the plate, the water is caused to flow radially outwardly from the point of impact, thus filling the arms of the spray arm. Since the water jet from the lower tower can strike the plate of the upper arm anywhere within the circular opening, more misalignment between the upper and lower rack can be tolerated than with the current design.

Surprisingly back splash is virtually eliminated, thus increasing the volume of wash liquid actually flowing through the arms.

DETAILED DESCRIPTION OF THE PREFERRED EMBODIMENTS

The present invention finds particular utility in upper spray arm for a domestic dishwasher, although it is not limited to such an environment. The present invention is useful in any arrangement where a liquid is being introduced in a stream to a hollow body. However, for purposes of illustration, the invention will be described in the environment of a domestic dishwasher spray arm.

Figure 1:
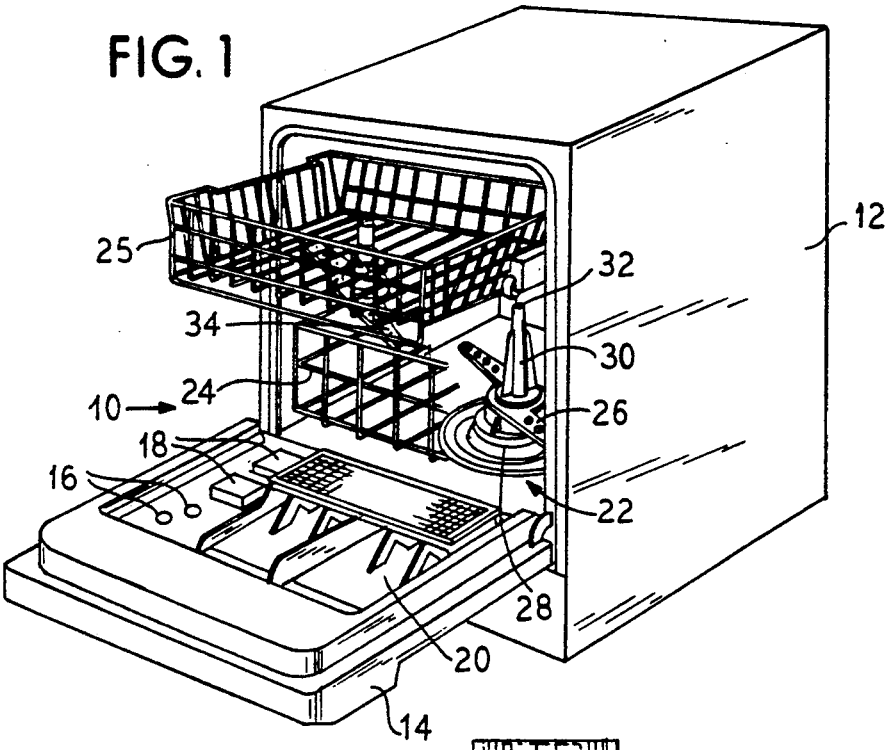
FIG. 1 is a perspective view of a domestic dishwasher incorporating the principles of the present invention.

A domestic dishwasher is illustrated generally at 10 in FIG. 1 and includes a surrounding enclosure 12 forming five solid walls and an openable door 14 forming the sixth wall. Receptacles for various wash additives are provided at 16 and 18, such additives including rinse liquid and detergent.

A rack 20 for holding silverware and other utensils is provided in the door 14 while within an interior 22 of the dishwasher there are two separate, individually movable dish racks 24, 25.

A lower spray arm 26 is mounted directly to a bottom wall 28 of the washer for horizontal rotary movement. A tower member 30 is secured for movement with the lower dishwasher rack 24 and, when the lower rack is moved into a closed position, it extends above an opening in the lower spray arm 26 to direct wash liquid vertically and out through a top opening 32 in the tower.

Figure 3:
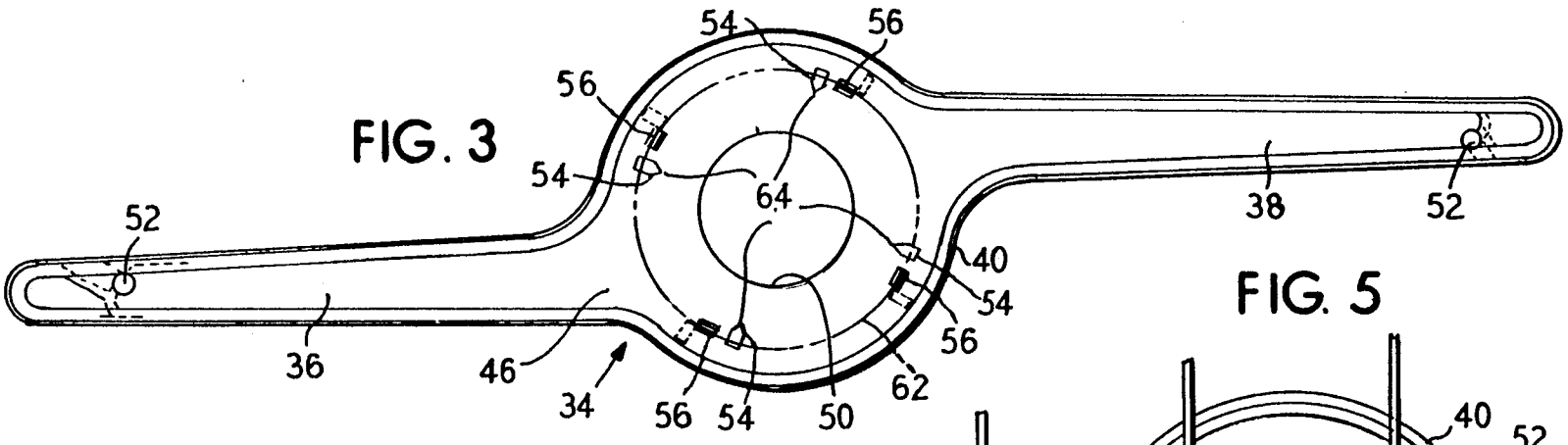
FIG. 3 is a bottom elevational view of the upper spray arm of FIG. 2.
Figure 5:
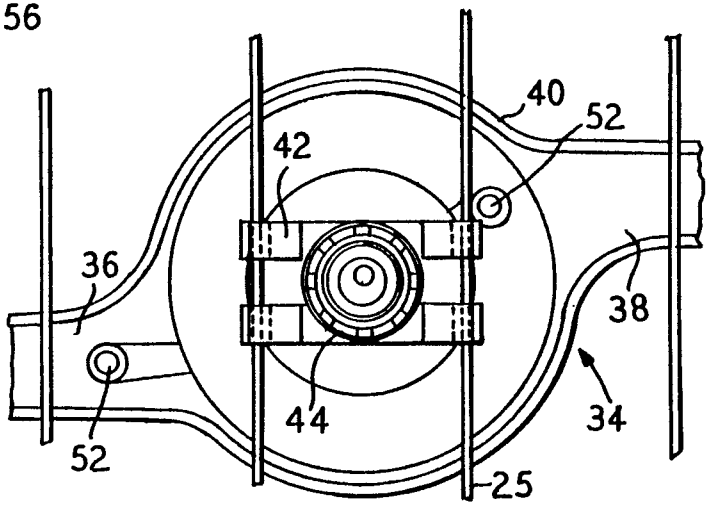
FIG. 5 is a partial plan view of the upper spray arm of FIG. 2.
Figure 2:
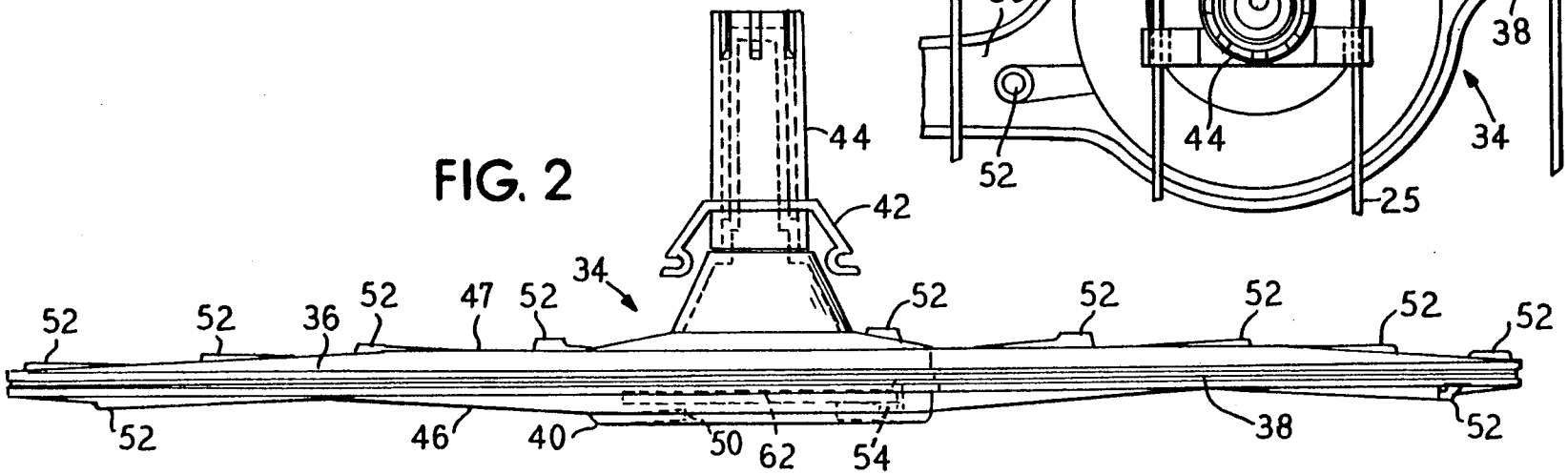
FIG. 2 is a side elevational view of an upper spray arm for a dishwasher.

An upper spray arm 34 is secured to an underside of the upper dishwasher rack 25 for rotary movement with respect to thereto. The upper spray arm 34 has two generally radially extending arms 36, 38 (FIGS. 2–3) which extend from a central hub portion 40 of the arm 34. A clip member 42 is secured to a sleeve 44 which forms a rotary bearing connection with the hub 40. The clip member 42 is configured to snap on to the dishwasher rack 25 (FIG. 5).

Figure 4:
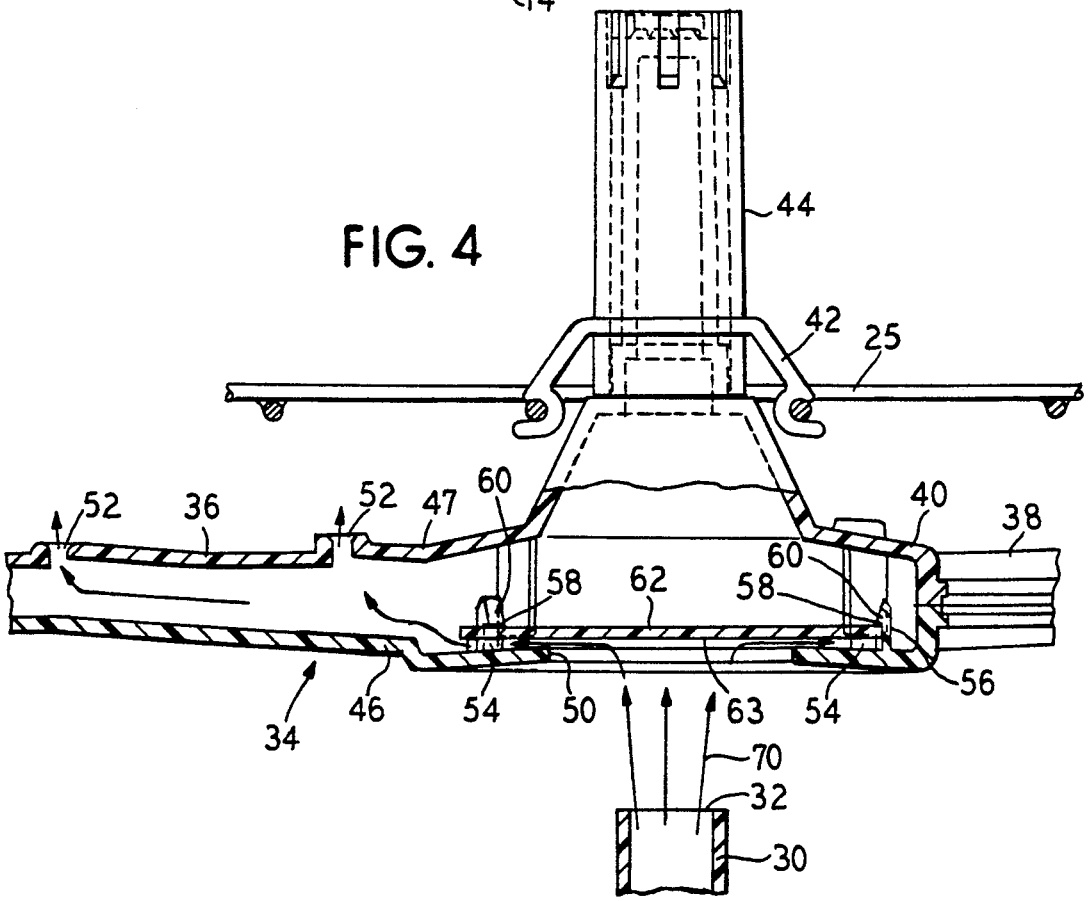
FIG. 4 is a partial side sectional view of the upper spray arm of FIG. 2.

A bottom wall 46 of the spray arm 34 is provided with a central circular opening 50 in the central hub portion 40 which will be positioned directly above the tower 30 when both the upper and lower dish racks are moved into their closed position (FIG. 4).

The interior of the upper spray arm 34 is hollow and it thus forms a large chamber for receiving wash liquid. A plurality of spray orifices 52 are provided at various locations in the bottom 46 and top 47 walls of the spray arm 34 to direct wash liquid to the underside of the articles carried in the upper dish rack 25.

The bottom wall 46, in the hub area 40, has four supports or spacers 54 which are spaced around the opening 50. Adjacent to each of the supports 54 is an upstanding finger 56 having a catch nose 56 formed at an upper end thereof. An upper surface 60 of the catch nose 56 is downwardly and inwardly sloped (FIG. 4). A rigid plate member 62 having a flat lower surface 63 is pressed against the upper surfaces 60 of the catch noses 56 causing them to cam outwardly until the plate member 62 passes the catch noses and is supported on the supports 54. The fingers 56 are formed of a resilient material and spring back to capture the plate member 62. Thus, the plate member 62 is captured in a fixed horizontal position spaced above the bottom wall 46, below the top wall 47 and extending radially beyond the opening 50.

The support members 54 have a pointed end 64 directed radially inwardly to provide a minimum amount of resistance to fluid flow past the supports.

When wash liquid is directed upwardly through the tower 30 it exits the top opening 32 in a column or jet 70 which impinges on the plate 62 and immediately fans radially outwardly due to the oncoming continuous stream of wash liquid. The wash liquid thus is immediately caused to flow radially within the interior of the spray arm assisting in the flow of wash liquid to the spray nozzle outlets 52.

Since the opening 50 of the arm is larger than the jet 70 of water, this design allows for significant misalignment between the lower rack 24 with tower 30 and the upper rack 25 with upper spray arm 34, without significantly effecting the wash performance of the upper arm 34. Surprisingly there is very little back splash when utilizing the plate member 62 and thus a greater volume of water is directed out of the outlets 52 on the upper spray arm enhancing the washing results provided by the dishwasher. Since the supports 54 and fingers 56 are molded as a part of the spray arm 34, only one additional part being plate 62, is required to complete the assembly. Assembly is readily accomplished in that the plate member 62 can be inserted in any rotational orientation since preferably it is a circular plate. Thus not only are performance enhancements achieved with the present invention, manufacturing and assembly costs are substantially reduced as well.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. An inlet in a bottom surface of a hollow interior spray arm member for a dishwasher having a central hub area and a plurality of arms extending approximately radially therefrom, said arms having holes therein from which wash liquid, received from a source of pressurized liquid in the form of a free jet not enclosed in a conduit, but directed along a path at said arm member, is to be ejected, said bottom surface consisting solely of a relatively flat surface, at least one of said holes and said inlet, said inlet comprising:

an opening formed as an unencumbered aperture in said bottom surface of said arm member positioned in said path of said free jet and communicating with said hollow interior of said arm member and a flat surface positioned within said interior perpendicular to and in said path.

2. An inlet according to claim 1, wherein said flat surface is provided by a plate secured to the interior of said arm member.

3. An inlet according to claim 2, wherein said plate is secured between a spacer fixed to a bottom wall of said arm member and a resilient finger having a catch nose spaced above said spacer.

4. An inlet according to claim 2, wherein said plate is circular.

5. An inlet according to claim 1, wherein said flat surface is spaced above a bottom wall and below a top wall of said arm member.

6. An inlet according to claim 1, wherein said opening is circular.

7. A spray arm for a dishwasher comprising:

a central hub area;

a plurality of arms extending approximately radially from said hub area, said arms having holes therein from which wash liquid received from a source of pressurized liquid in the form of a free jet not enclosed in a conduit, but directed along a path at said spray arm is to be ejected;

said hub area and said arms having a relatively flat bottom wall;

an inlet formed as an unencumbered aperture in said bottom wall of said spray arm positioned in said path of said free jet, and a flat surface spaced above said bottom wall and positioned above said inlet perpendicular to and in said path;

wherein, said liquid jet will flow unimpeded into said spray arm through said inlet and impinge on said flat surface and be caused to flow radially outwardly from said path without significant backsplash outside of said spray arm.

8. A spray arm according to claim 7, wherein said flat surface is provided by a plate secured to an interior of said spray arm.

9. A spray arm according to claim 8, wherein said plate is secured between a spacer fixed to said bottom wall of said spray arm and a resilient finger having a catch nose spaced above said spacer.

10. A spray arm according to claim 8, wherein said plate is circular.

11. A spray arm according to claim 7, wherein said flat surface is spaced below a top wall of said spray arm.

12. A spray arm according to claim 7, wherein said inlet is circular.

13. An inlet for a member having a hollow interior which is to receive a liquid in the form of a free jet not enclosed in a conduit, but directed along a path at said member, said inlet comprising:

an opening formed as an unencumbered aperture in a surface of said member positioned in said path of said free jet and communicating with said hollow interior of said member, said aperture being the sole means for said free jet to enter said member and a flat surface positioned within said interior generally perpendicular to and in said path.

14. An inlet according to claim 13, wherein said flat surface is provided by a plate secured to the interior of said member.

15. An inlet according to claim 14, wherein said plate is secured between a spacer fixed to a bottom wall of said member and a resilient finger having a catch nose spaced above said spacer.

16. An inlet according to claim 14, wherein said plate is circular.

17. An inlet according to claim 13, wherein said flat surface is spaced above a bottom wall and below a top wall of said member.

18. An inlet according to claim 13, wherein said opening is circular.

* * * * *